US007681330B2

(12) United States Patent
Lewis

(10) Patent No.: US 7,681,330 B2
(45) Date of Patent: Mar. 23, 2010

(54) FOOTWEAR HAVING REMOVABLE STRAPS

(75) Inventor: John Lewis, 1514 Hunsaker St., Oceanside, CA (US) 92054

(73) Assignee: John Lewis, Oceanside, CA (US)

( * ) Notice: Subject to any disclaimer, the term of this patent is extended or adjusted under 35 U.S.C. 154(b) by 694 days.

(21) Appl. No.: 11/558,356

(22) Filed: Nov. 9, 2006

(65) Prior Publication Data

US 2008/0110054 A1 May 15, 2008

(51) Int. Cl.
*A43B 3/12* (2006.01)

(52) U.S. Cl. ..... 36/11.5; 36/15; 36/100

(58) Field of Classification Search ..... 36/11.5, 36/15, 100, 101
See application file for complete search history.

(56) References Cited

U.S. PATENT DOCUMENTS

| | | | | |
|---|---|---|---|---|
| 3,154,866 | A | 11/1964 | Laufbahn | |
| 4,172,330 | A | 10/1979 | Kao | |
| 4,839,948 | A * | 6/1989 | Boros | 24/662 |
| 5,065,531 | A * | 11/1991 | Prestridge | 36/100 |
| 5,317,822 | A * | 6/1994 | Johnson | 36/101 |
| 5,836,090 | A | 11/1998 | Smith | |
| 5,896,684 | A | 4/1999 | Lin | |
| 6,792,696 | B2 | 9/2004 | Berg et al. | |
| 6,848,199 | B1 | 2/2005 | Giannelli | |
| 6,904,706 | B2 | 6/2005 | Jones et al. | |
| 6,928,754 | B2 * | 8/2005 | Cambronero | 36/11.5 |
| 6,931,766 | B2 | 8/2005 | Greene | |
| 7,222,441 | B2 * | 5/2007 | Smith et al. | 36/11.5 |
| 7,266,907 | B2 * | 9/2007 | Dushey | 36/11.5 |
| 7,318,289 | B2 * | 1/2008 | Chan | 36/11.5 |
| 2005/0016019 | A1 * | 1/2005 | Smith et al. | 36/11.5 |
| 2006/0112597 | A1 * | 6/2006 | Stern et al. | 36/101 |
| 2006/0242861 | A1 * | 11/2006 | Dushey | 36/101 |
| 2007/0245597 | A1 * | 10/2007 | Krutilek et al. | 36/101 |
| 2008/0052958 | A1 * | 3/2008 | Pan | 36/11.5 |
| 2008/0060227 | A1 * | 3/2008 | Enderson | 36/100 |

* cited by examiner

*Primary Examiner*—Marie Patterson
(74) *Attorney, Agent, or Firm*—Baumgartner Patent Law

(57) ABSTRACT

Footwear having removable straps is disclosed herein. More specifically, the footwear disclosed herein includes a removable strap assembly having concealed releasable connection means for attaching to the sole of the footwear.

9 Claims, 2 Drawing Sheets

FOOTWEAR HAVING REMOVABLE STRAPS

FIELD OF THE INVENTION

The present invention generally relates to footwear having removable straps.

BACKGROUND

Footwear having removable straps can be advantageous as they allow the wearer to have more fashion options when dressing. For example, a wearer can select different colors or styles of straps to match different outfits they are wearing, without having to buy entirely new footwear.

Prior attempts to design reversible footwear have disadvantages. For example, U.S. Pat. No. 5,896,684 to Lin discloses a detachable strap on footwear, but the means for connecting the strap to the footwear is readily visible to the user and others. This configuration is highly undesirable to fashion conscious consumers.

U.S. Pat. No. 3,154,866 to Laufbahn, discloses footwear having detachable components, where the fastener means are hidden from the user. According to this patent, the fastener means can include a flange located at the end of a thong strap that is received into the wide portion of a key-hole shaped aperture in the sole of the thong and then moved forward to the narrow end of the keyhole, thus preventing detachment by direct upward movement. See FIG. 6, and col. 4 lines 6-19. However, the straps described in this patent are not entirely secure. For example, if the strap was inadvertently slid backwards, the strap could easily become disengaged from the sole of the footwear.

U.S. Pat. No. 4,172,330 to Kao also discloses footwear having a removable strap where the means for connecting the strap to the sole are hidden. However, the attachment means for this design are complicated such that they would require a significant amount of time to change straps. Furthermore, the attachment means have many parts (e.g., loose pins and button members) that could easily be lost.

U.S. Pat. No. 6,848,199 to Giannelli describes footwear having removable straps that attach by quick-release connection means. While mentioning a female connecting member, configured to receive a male connecting member, recessed in the sole of the footwear such that only a slot is visible, this patent does not suggest or teach a way to detach the secured male and female connecting members that are recessed within the outsole, other than rotating the strap. More specifically, this patent fails to recognize the difficulties associated with releasing a completely recessed quick-release connection means, such as buckles and snap fasteners that cannot be detached by simple rotation.

There is a need in the art to provide footwear having removable straps wherein the straps can be securely attached and the means for attachment are hidden from view. Accordingly, one object of the invention is to provide new and improved footwear having removable straps with connection means that are hidden from the user. Another more specific object of the invention is to provide new and improved footwear having secure, quick-release connection means that are concealed but can be easily released by the user.

SUMMARY OF THE INVENTION

According to certain embodiments, the teachings herein disclose footwear including a sole and a strap assembly, the sole having a plurality of embedded, open-ended channels individually housing a first connection member having a base anchored by an elastic cord; wherein the strap assembly is coupled to a plurality of second connection members having means for releasably engaging with the plurality of first connection members.

In certain embodiments the strap assembly is a single strap having a pair of second connection members. In further aspects, the strap assembly includes a front strap connected to two back straps, wherein each strap is individually coupled to a second connection member. In more specific embodiments, the plurality of first connection members individually comprise a male component of a quick release buckle and the plurality of second connection members individually comprise a female component of the quick release buckle.

In other aspects, the channels of the footwear described herein can more specifically include inner grooves conforming to the sides of the male and female components of the quick release buckle.

In still further embodiments, the base of the channels can individually include a small hole wherein the elastic cord is configured into a knot outside the channel such that the knot cannot pass through the small hole.

Additional aspects of the teachings herein include footwear including a sole having a plurality of embedded, open-ended channels individually housing a first connection member anchored by an elastic cord and having means for releasably engaging with a second connection member. In advantageous embodiments, the footwear described herein can include 2, 3, 4, 5 or more channels, and connection members.

Other embodiments relate to footwear having a sole and a strap assembly, wherein the sole is coupled to a plurality of first connection members; and the strap assembly includes a plurality of pockets individually housing a second connection member configured to releasably engage with the plurality of first connection members, such that when said first and second connection members are engaged, they are concealed within the pockets. In advantageous embodiments, the footwear described herein can include 2, 3, 4, 5, or more pockets and connection members.

BRIEF DESCRIPTION OF THE DRAWINGS

It will be appreciated that the drawings are not necessarily to scale, with emphasis instead being placed on illustrating the various aspects and features of embodiments of the invention, in which.

DETAILED DESCRIPTION OF THE ILLUSTRATED EMBODIMENTS

Figure 2:
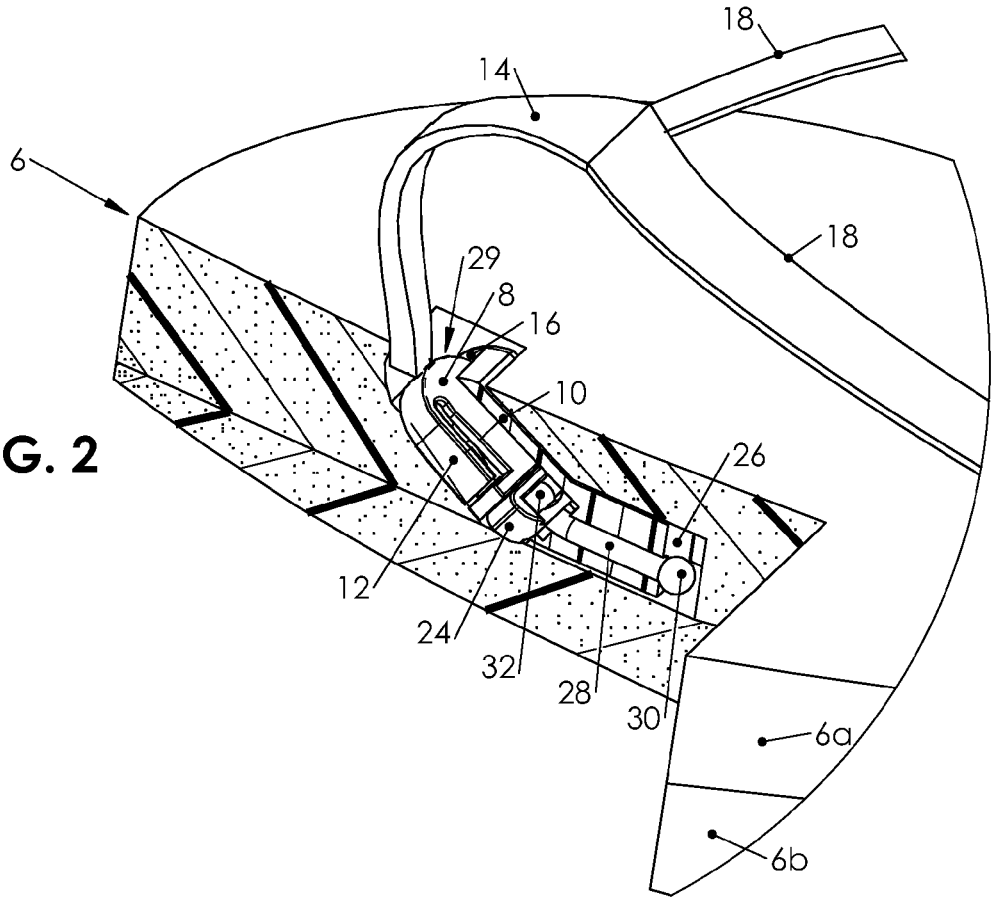
FIG. 2 is a cross-sectional view of one embodiment of attached and recessed releasable connection means.

Embodiments of the present invention are described below. It is, however, expressly noted that the present invention is not limited to these embodiments, but rather the intention is that modifications that are apparent to the person skilled in the art and equivalents thereof are also included.

In preferred embodiments, the teachings herein are directed to footwear having removable straps, wherein the means for releasably connecting the straps to the footwear are concealed from view. In more specific embodiments, the footwear herein includes secure, quick-release connection means that are concealed but can be easily released by the user.

Embodiments of the invention will now be described with reference to the accompanying figures, wherein like numerals refer to like elements throughout. The terminology used in the description presented herein is not intended to be interpreted in any limited or restrictive manner simply because it is being utilized in conjunction with a detailed description of certain specific embodiments of the invention.

FIGS. 1-4 demonstrate a particular advantageous embodiment. According to this embodiment, the footwear 2 includes a sole 6 comprising an upper sole 6*a* and a lower sole 6*b* and a removable upper strap assembly 4 that includes two back straps 18 and a front strap 14.

Figure 1:
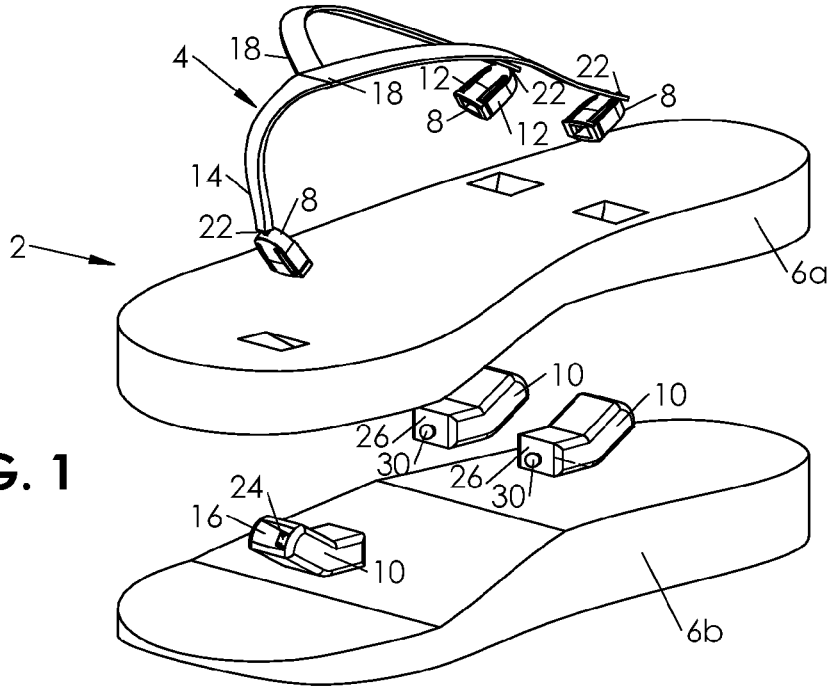
FIG. 1 is a partly exploded view of one embodiment of footwear according to the teachings provided herein.

Referring to FIG. 1, the front strap 14 and back straps 18 are each attached to a female member 8 of a releasable buckle 29 having release buttons 12 located on the sides. The straps can be attached to the female member 8 by any suitable means, including being secured around a small ring 22 located on the top of the female member 8.

With continued reference to FIGS. 1-4, the sole 6 includes three channels 10 that individually house a male member 24 of a releasable buckle 29. The channels 10, can be embedded into the sole 6 of the footwear, according to methods known to those with skill in the art, including but not limited to molding techniques. FIG. 1. depicts one embodiment for making the footwear. According to this embodiment, the channels are embedded in between an upper sole 6*a* and a lower sole 6*b*.

In advantageous embodiments, the male member 24 includes a base attached to an elastic cord 28 that is anchored within, outside, or to the channel 10 (See FIG. 2). According to preferred embodiments, the elastic cord 28 is tied, such as in a knot 30, outside of the channel to anchor the cord 28. In more specific embodiments, the bottom end 26 of the channel 10 can include a small hole configured to allow the elastic cord 28 through, but not the knot 30, thereby anchoring the elastic cord 28. Any suitable means for anchoring the elastic cord 28 can be used with the teachings herein including, but not limited to, securing the cord 28 within, outside or to the channel by attaching the cord 28 to a small pin or ring, for example.

The non-anchored end of the cord 28 can be coupled to the base of the male member 24 through a second knot 32, or any other suitable means for connection.

With respect to FIG. 2, the female member 8 of the buckle 29 can be pushed into the channel 10 to connect with the recessed male member 24 of the buckle 29. In advantageous embodiments, the channel 10 contains inner grooves 16 on its sides that act as a sliding track for the sides of the female member 8 and the male member 24. According to these preferred embodiments, when the female member 8 is moved into the channel, its' sides slide along the inner grooves 16 of the channel 10 guiding the female member 8 to connect with the male member 24, thus securely fastening the buckle 29. According, to preferred embodiments, and as depicted in FIG. 2, after connecting the female member 8 to the male member 24, the buckle 29 is secured and concealed within the channel 10.

Figure 3:
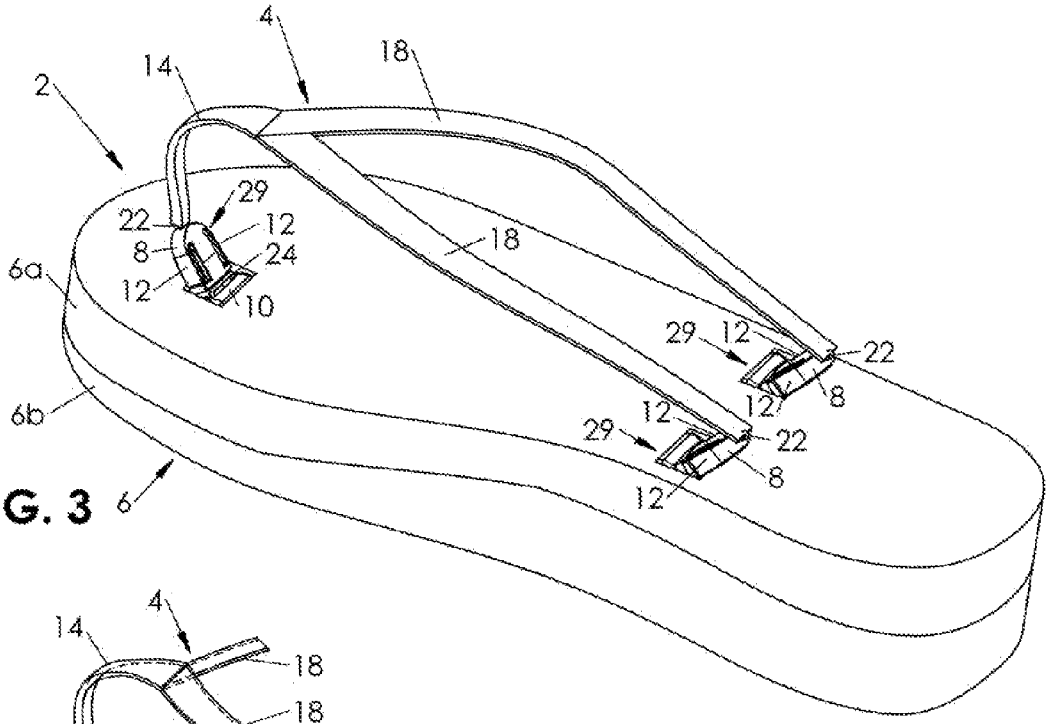
FIG. 3 is a perspective view of one embodiment of attached and exposed releasable connection means.
Figure 4:
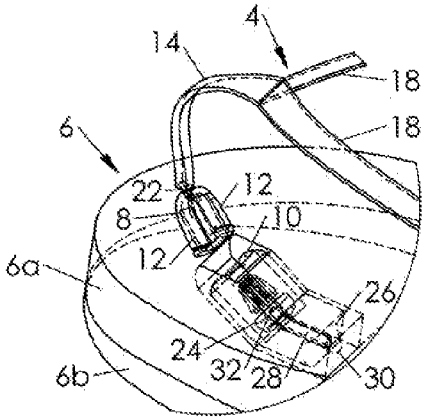
FIG. 4 is a close-up view of one embodiment of a detached and recessed female connecting member.

Attaching and anchoring the elastic cord 28 to the base of the male member 24 is advantageous within certain embodiments as it allows a user to easily detach the female member 8 from the male member 24. FIG. 3. shows an advantageous embodiment of how to disengage the buckle 29 that is recessed within the channel 10. According to this embodiment, a user simply pulls the front strap 14 or the back straps 18 away from the channel 10. The pull on the front strap 14 or back straps 18 pulls the attached buckle 29 out of the channel 10 and expands the elastic cord 28 attached to the base of the male member 24. Once the buckle 29 is exposed outside of the channel 10, a user can press the side release buttons 12 to disengage the female member 8 from the male member 24. After the female member 8 is released from the male member 24, the elastic cord 28 contracts and retracts the male member 24 back into the channel 10 as shown in FIG. 4.

In advantageous embodiments, the grooves 16 within the channel 10 act as tracks that guide the male member 24 back into the channel 10 into the desired alignment, so that it is positioned to engage with a female member 8 again. Accordingly, in preferred embodiments, the elastic cord 28 has sufficient elasticity to allow the buckle 29 to be exposed from the channel 10 when the front strap 14 is pulled (as shown in FIG. 3), and to recess the male member 24 after disengagement of the buckle 29 (as shown in FIG. 4).

It is contemplated that the male members and female members of the buckles described herein can readily be interchanged, such that the male member is attached to a strap and the female member is housed within a channel. It is further disclosed that any suitable buckle other than those pictured in FIGS. 1-4, including releasable connection means (e.g., snap fasteners, hook and loop fasteners, and the like) can be used with the teachings herein.

The number of channels located in the sole 6 can vary depending on the number of straps used. While shown in FIGS. 1-4 as angled (approximately 120, 140, 150, or 160 degrees), the channels can be readily adapted to other configurations. For example, depending on the thickness of the sole of the footwear, an angled configuration may not be advantageous. According to certain embodiments, especially where the footwear has a thicker sole, the channel can be configured to be straight up and down, such that the male member is housed more vertically within the channel as opposed to the positions shown in FIGS. 1-4. In embodiments where the sole is thin, the channels can be horizontal, or near horizontal, having an upward opening, within the sole, for example. Various shapes and configurations of the channels are contemplated herein, including L-shaped, curved, straight, cylindrical, and rectangular, and the like, for example.

Figure 5:
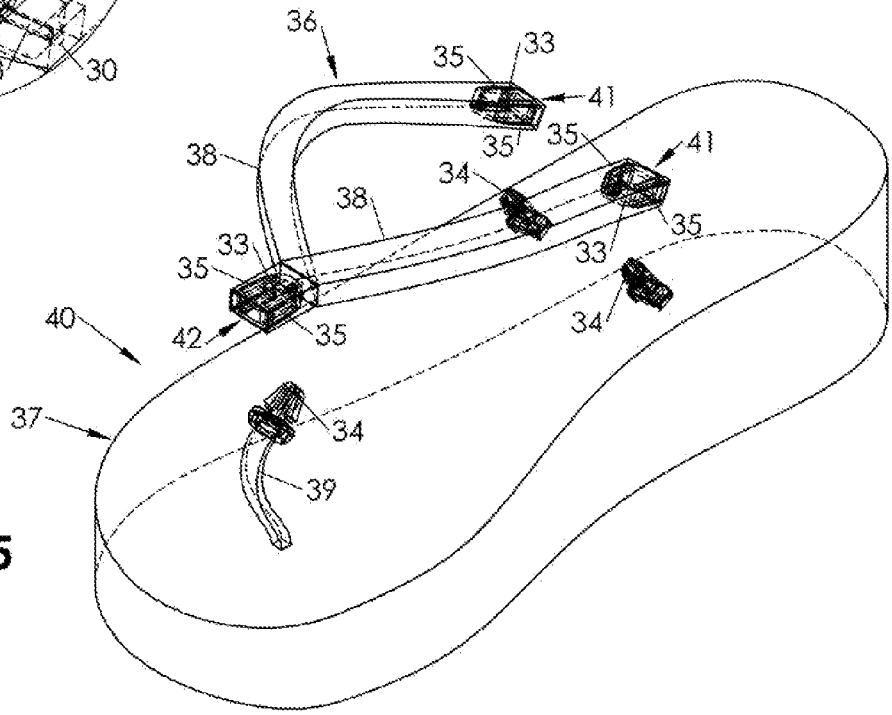
FIG. 5 is a perspective view of one embodiment of footwear according to the teachings provided herein.

FIG. 5 depicts another embodiment of footwear 40 having concealed releasable connection means. According to FIG. 5, footwear is depicted having a detachable strap assembly 36 comprising a front pocket 42 and two back straps 38 each having individual pockets 41 at their ends. The front pocket 42 and the back pockets 41 individually house recessed female members 33 of means for releasable connection with corresponding male members 34 that are coupled to the sole 37 of the footwear 40. The female members 33 can be held in position within the front pocket 42 or back pocket 41 by any suitable attachment means. In preferred embodiments, the female members 33 and male members 34 connect within their respective pockets, such that the releasable connection means are concealed. The front male member is preferably attached by a front strap 39 that can separate the user's toes. After engagement, a user can detach the means for releasable connection, by pressing the release buttons 35 on sides of the female members 33 through the outside of the back pocket 41 or front pocket 42. Male and female members can readily be interchanged according to these embodiments. The number of pockets, male and female members, and their positioning can be varied.

According to this embodiment, any suitable releasable connection means can be housed within the pockets including, but not limited to quick-release buckles, snap fasteners, hook and loop fasteners, and the like, such as those described in the embodiments depicted in FIGS. 1-4 above, for example. In preferred embodiments the means for releasable connection have a release mechanism that can be activated by a user outside of the pocket (e.g., pressing 1 or more release buttons through the outside of the pocket). In still other embodiments, the female members can be anchored within the pockets by an elastic cord, and be attached and released to a corresponding male member through the mechanisms similar to those described in FIGS. 1-4.

The soles of the all the embodiments encompassed herein can be made of any suitable material including but not limited to leather, synthetic leather, rubber, foam, and the like, including combinations thereof. In certain embodiments, the sole can include a single layer or multiple layers of material. The strap assembly can be made of any suitable material including but not limited to nylon, leather, synthetic letter, woven fabric, cotton, textiles, and the like, including combinations thereof. Variations on the specific number, thickness, and types of straps of the strap assembly are included in the teachings herein. For example, the strap assembly may contain just 1 strap, or 2, 3 4, 5, 6, or more straps, including, but not limited to 1 or more side to side straps, 1 or more front straps, 1 or more back straps and/or 1 or more heel straps.

The invention may be embodied in other specific forms besides and beyond those described herein. The foregoing embodiments are therefore to be considered in all respects illustrative rather than limiting, and the scope of the invention is defined and limited only by the appended claims and their equivalents, rather than by the foregoing description.

The invention claimed is:

1. Footwear comprising: a sole and a strap assembly, the sole comprising a plurality of embedded, open-ended channels individually housing a first connection member having a base anchored by an elastic cord; and the strap assembly coupled to a plurality of second connection members having means for releasably engaging with the plurality of first connection members, wherein the plurality of first connection members individually comprise a male component of a quick release buckle and the plurality of second connection members individually comprise a female component of the quick release buckle, and the channels comprise inner grooves conforming to the sides of the male and female components of the quick release buckle.

2. The footwear according to claim 1, wherein the strap assembly is a single strap having a pair of second connection members.

3. The footwear according to claim 1, wherein the strap assembly comprises a front strap connected to two back straps, each strap individually coupled to a second connection member.

4. The footwear according to claim 1, wherein the base of the channels individually comprise a small hole and wherein the elastic cord is configured into a knot outside the channel such that the knot cannot pass through the small hole.

5. Footwear comprising: a sole and a strap assembly, the sole comprising a plurality of embedded, open-ended channels individually housing a first connection member having a base anchored by an elastic cord; and the strap assembly coupled to a plurality of second connection members having means for releasably engaging with the plurality of first connection members, wherein the plurality of first connection members individually comprise a female component of a quick release buckle and the plurality of second connection members individually comprise a male component of the quick release buckle, and the channels comprise inner grooves conforming to the sides of the male and female components of the quick release buckle.

6. The footwear according to claim 5, wherein the strap assembly is a single strap having a pair of second connection members.

7. The footwear according to claim 5, wherein the strap assembly comprises a front strap connected to two back straps, each strap individually coupled to a second connection member.

8. The footwear according to claim 5, wherein the base of the channels individually comprise a small hole and wherein the elastic cord is configured into a knot outside the channel such that the knot cannot pass through the small hole.

9. Footwear comprising: a sole and a strap assembly, the sole coupled to a plurality of first connection members; and the strap assembly comprising a plurality of pockets individually housing a second connection member configured to releasably engage with the plurality of first connection members, such that when said first and second connection members are engaged, they are concealed within the pockets.

* * * * *